US008146416B2

(12) United States Patent
Pisio et al.

(10) Patent No.: US 8,146,416 B2
(45) Date of Patent: Apr. 3, 2012

(54) METHODS AND APPARATUS TO PERFORM STRESS TESTING OF GEOLOGICAL FORMATIONS

(75) Inventors: Vincent Pisio, Edmonton (CA); Edward Harrigan, Richmond, TX (US); John Edwards, Sultanate of Oman (OM); Paul Howard, Sugar Land, TX (US); Koksal Cig, Izmir (TR); Richard Marcinew, Alberta (CA); Carsten Sonne, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 530 days.

(21) Appl. No.: 12/408,850

(22) Filed: Mar. 23, 2009

(65) Prior Publication Data

US 2010/0206548 A1 Aug. 19, 2010

Related U.S. Application Data

(60) Provisional application No. 61/152,497, filed on Feb. 13, 2009.

(51) Int. Cl.
*E21B 47/06* (2012.01)

(52) U.S. Cl. ..... 73/152.51

(58) Field of Classification Search ..... None
See application file for complete search history.

(56) References Cited

U.S. PATENT DOCUMENTS

| | | | | |
|---|---|---|---|---|
| 4,220,205 | A | 9/1980 | Coursen et al. | |
| 4,665,984 | A | 5/1987 | Hayashi et al. | |
| 5,165,276 | A | 11/1992 | Thiercelin | |
| 5,295,393 | A | 3/1994 | Thiercelin | |
| 5,353,637 | A | 10/1994 | Plumb et al. | |
| 5,517,854 | A | 5/1996 | Plumb et al. | |
| 6,724,687 | B1 * | 4/2004 | Stephenson et al. | 367/32 |
| 7,100,688 | B2 * | 9/2006 | Stephenson et al. | 166/250.1 |
| 7,185,703 | B2 * | 3/2007 | Jannise et al. | 166/308.1 |
| 7,392,851 | B2 | 7/2008 | Brennan, III et al. | |

FOREIGN PATENT DOCUMENTS

GB 2257448 1/1993

OTHER PUBLICATIONS

Desroches, Jean et al., Applications of Wireline Stress Measurements, SPE 58086, New Orleans, LA, Sep. 27-30, Oct. 1999.

* cited by examiner

*Primary Examiner* — Robert R Raevis
(74) *Attorney, Agent, or Firm* — David Hofman; Michael L. Flynn; Jody Lynn DeStefanis

(57) ABSTRACT

Example methods and apparatus to perform stress testing of geological formations are disclosed. A disclosed example downhole stress test tool for pressure testing a geological formation comprises first and second packers selectively inflatable to form an annular region around the tool, a container configured to store a fracturing fluid, wherein the fracturing fluid is different than a formation fluid and a drilling fluid, a pump configured to pump the fracturing fluid into the first and second packers to inflate the first and second packers and to pump the fracturing fluid into the annular region to induce a fracture of the geological formation, and a sensor configured to detect a pressure of the fracturing fluid pumped into the annular region corresponding to the fracture of the geological formation.

20 Claims, 6 Drawing Sheets

METHODS AND APPARATUS TO PERFORM STRESS TESTING OF GEOLOGICAL FORMATIONS

RELATED APPLICATIONS

This patent claims benefit from U.S. Provisional Application Ser. No. 61/152,497, entitled "Methods and Apparatus to Perform Stress Testing of Geological Formations," filed on Feb. 13, 2009, and which is hereby incorporated by reference in its entirety.

BACKGROUND

Wellbores are drilled to, for example, locate and produce hydrocarbons. During a drilling operation, it may be desirable to perform evaluations of the geological formations penetrated and/or encountered formation fluids. In some cases, a drilling tool is removed and a wireline tool is then deployed into the wellbore to test and/or sample the formation and/or fluids associated with the formation. In other cases, the drilling tool may be provided with devices to test and/or sample the surrounding formation and/or formation fluids without the need to remove the drilling tool from the wellbore. These samples or tests may be used, for example, to characterize hydrocarbons and/or a geological formation.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of the various features may be arbitrarily increased or reduced for clarity of discussion. Moreover, while certain embodiments are disclosed herein, other embodiments may be utilized and structural changes may be made without departing from the scope of the invention.

DETAILED DESCRIPTION

Figure 1B:
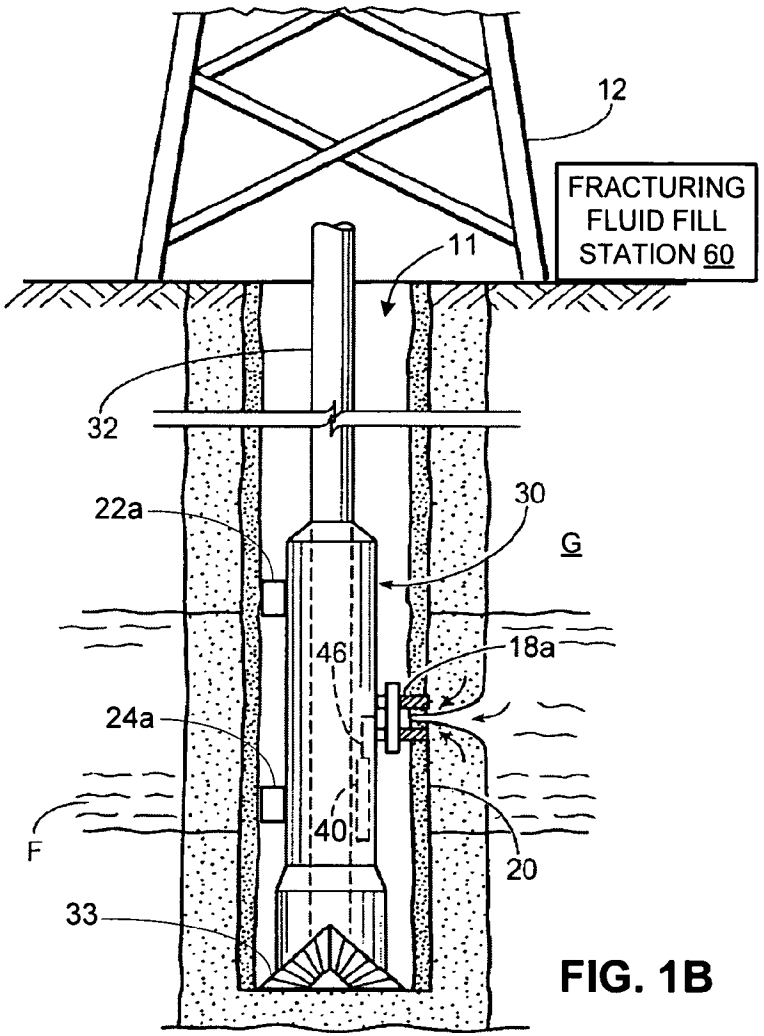
FIG. 1B depicts an example drill string assembly that may be used to perform stress testing of geological formations according to one or more aspects of the present disclosure.

Knowledge of in situ or downhole stresses is useful for characterizing, identifying and/or resolving problems related to rock mechanics. Rock mechanics may affect, among other things, hydrocarbon production rates, well stability, sand control and/or horizontal well planning. Downhole formation stress information determined during geological formation exploration (e.g., during a wireline testing process and/or during a logging-while-drilling (LWD) process) may be used to, for example, design, select and/or identify fracturing treatments used to increase hydrocarbon production.

Hydraulic fracturing is a testing technique for measuring downhole geological formation stresses. Additionally, the technique may be used to analyze fluid leak-off behavior, and determine other reservoir properties such as permeability and pressure. To perform hydraulic fracturing, a fluid is injected into a defined interval until a fracture of a geological formation is created and propagated. The pressure of the injected fluid is measured before, during and after the injection period. The value of the stress acting normal to the fracture surface is determined by monitoring the pressures associated with initiation, propagation, closure, and re-opening of the induced fracture. In general, the induced fracture grows perpendicular to the direction of the minimum horizontal stress. If the fracture extends to a length of about four wellbore radii, then the fracture senses mostly the far-field stresses, that is, the stresses away from the wellbore itself. Accordingly, the pressure record can be analyzed to detect at which pressure the fracture closes, which represents an estimate of the far-field minimum stress of the geological formation. Further, were a fracturing fluid used during stress testing similar to that used subsequently to perform a pre-production fracturing process, a fluid loss rate measured during the formation stress test can be used to compute and/or estimate a fluid efficiency for the pre-production fracture. Such information can be used to design and/or specify the pre-production fracturing process.

Formation fluids and/or drilling mud fluids have traditionally been used to perform hydraulic fracturing during formation exploration. Because formation fluids and/or drilling mud fluids often contain solids, the use of such fluids may result in an undesirable build-up of solids within a pump module causing the pump module to fail prematurely. When such failures occur, an entire measuring system may have to be withdrawn from a wellbore in order to replace the failed pump module, causing significantly increased costs and/or time associated with exploration of a formation. Moreover, such fluids may have inadequate and/or insufficient viscosity to prevent and/or reduce high leak-off of the fluid in higher permeability environments. A sufficiently high leak-off rate may prevent enough pressure build-up to fracture the formation. Further still, some fluids may react adversely with a formation F to be tested. For example, some formations F may react adversely with a water-based mud fluid.

To overcome these difficulties, the example downhole tools described herein include a container configured to store and transport a fracturing fluid to be used for hydraulic fracturing. The container is filled with the fracturing fluid while the downhole tool is located at an above ground location. As described herein, the fracturing fluid may be isolated from other fluids within or outside the tool, such as formation fluids and/or drilling mud fluids, to reduce contamination of the fracturing fluid. Accordingly, a pump module used to perform hydraulic fracturing with the fracturing fluid need not be exposed to the solids contained in formation fluids and/or drilling mud fluids, thereby increasing the reliability and/or lifespan of the pump module. Moreover, fluids that are more viscous than formation and/or drilling fluids may be stored in the container and, thus, permit stress testing in highly permeable environments. Further still, a higher-viscosity fluid permits the creation of a greater pressure differential for a given flow rate, while not altering and/or adversely affecting the geo-mechanical results obtained via the hydraulic fracturing stress test. Additionally or alternatively, the fracturing fluid may be selected to reduce and/or avoid adverse reactions that may occur between the fracturing fluid and the formation other than, of course, the intentionally induced fracture. That is, the fracturing fluid may be selected based on how the fracturing fluid may or may not react with the formation to be tested. For example, if the formation to be tested may react adversely to a hydrocarbon, a water-based fracturing fluid could be selected. Likewise, were the formation to be tested likely to react adversely to a water-based fluid, an oil-based fracturing fluid could be selected. The fracturing fluid may also be selected based on any number and/or type(s) of additional and/or alternative criteria. For example, the fracturing fluid can be selected to reduce and/or control leak off into the formation. Moreover, the fracturing fluid may be selected based on any combination of criteria. For example, the fracturing fluid can be selected to have a viscosity sufficient to create a desired pressure differential and to reduce leak off into the formation.

During pre-production hydraulic fracturing performed to increase hydrocarbon production, a fracturing fluid may be fluidly coupled from an above ground device down through a wellbore to a downhole location where the fracturing is to be performed. However, the setup and equipment complexity and costs associated with transporting fluid down through a wellbore to a fracturing site are prohibitive for exploration and/or characterization of a geological formation. As such, the example downhole tools described herein realize significant complexity and costs savings over existing methods of measuring the stresses associated with a geological formation, along with obtaining design parameters such as fracturing fluid-loss behavior, formation transmissibility/permeability, and reservoir pore-pressure.

While the examples disclosed herein describe performing a hydraulic stress test within a packed-off region and/or interval, the example downhole tools and methods described herein may be used, additionally or alternatively, to perform sleeve fracturing. To perform a sleeve fracture, the fracturing fluid transported within the downhole tool to within the formation is used to inflate a packer to form and/or induce a fracture of the formation at and/or in the vicinity of the packer. The packer is then deflated (reclaiming at least some of the fracturing fluid), and the tool repositioned with the fracture positioned between two packers of the downhole tool. The packers are then inflated to form a packed off interval that includes the fracture, and hydraulic fracturing performed with the fracturing fluid to hydraulically reopen the fracture.

Figure 1A:
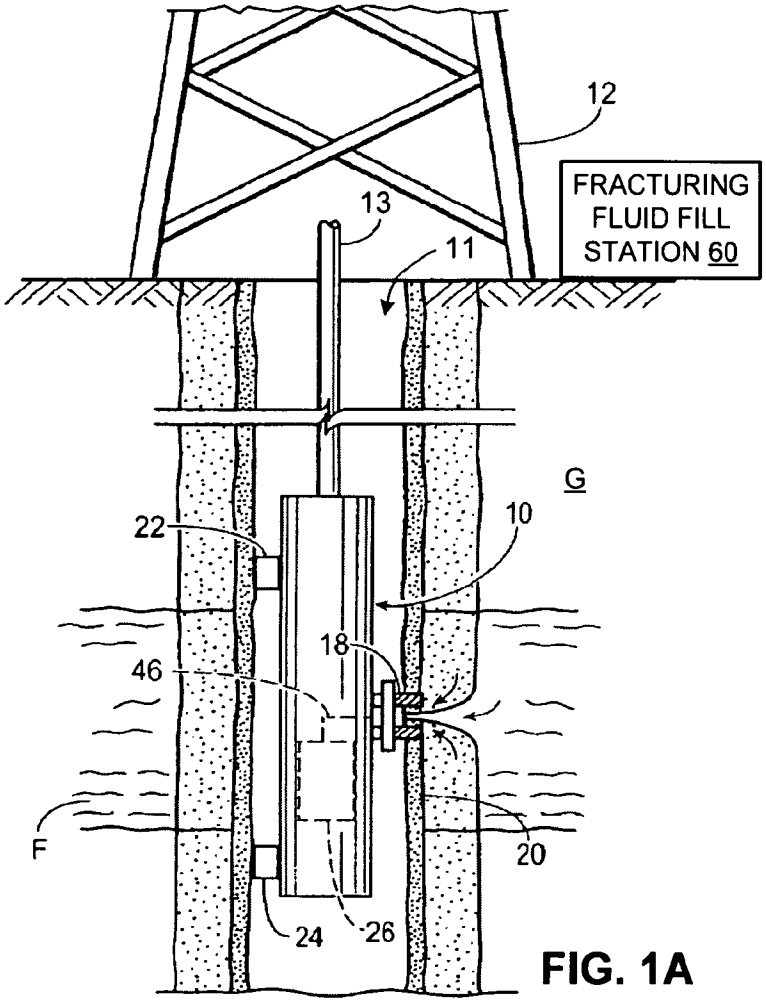
FIG. 1A depicts an example wireline assembly that may be used to perform stress testing of geological formations according to one or more aspects of the present disclosure.

FIG. 1A shows a schematic, partial cross-sectional view of an example downhole tool 10 that can be employed onshore and/or offshore. The example downhole tool 10 of FIG. 1A is suspended in a wellbore 11 formed in a geologic formation G by a rig 12. The example downhole tool 10 can implement any type of downhole tool capable of performing formation evaluation, such as x-ray fluorescence, fluid analysis, fluid sampling, well logging, formation stress testing, etc. The example downhole tool 10 of FIG. 1A is a downhole wireline tool deployed from the rig 12 into the wellbore 11 via a wireline cable 13, and positioned adjacent to a particular geologic formation F. The wellbore 11 may be formed in the geological formation G by rotary and/or directional drilling.

To seal the example downhole tool 10 of FIG. 1A to a wall 20 of the wellbore 11 (hereinafter referred to as a "wall 20" or "wellbore wall 20"), the example downhole tool 10 may include a probe 18. The example probe 18 of FIG. 1A forms a seal against the wall 20 and may be used to draw fluid(s) from the formation F into the downhole tool 10 as depicted by the arrows. Backup pistons 22 and 24 assist in pushing the example probe 18 of the downhole tool 10 against the wellbore wall 20.

To perform formation stress tests, the example downhole tool 10 of FIG. 1A includes (or itself may be) a stress test module 26 constructed in accordance with this disclosure. As described below in connection with FIG. 2, the example stress test module 26 includes one or more containers 235 and 236 (FIG. 2) configured to store fracturing fluid(s) to be used for stress testing of the formation F. The example stress test module 26 is fluidly coupled to the probe 18 and/or another port of the tool 10 via a flowline 46.

To load and/or fill the container(s) 235 and 236 of the stress test module 26 with fluid(s) to be used in stress testing the formation F, the illustrated example of FIG. 1A includes a fracturing fluid fill station 60. While the example stress test module 26 is located above ground, that is, outside of the formations G and F and the wellbore 11, the example fracturing fluid fill station 60 may be fluidly coupled to the stress test module 26 to fill the one or more containers 235 and 236 of the stress test module 26 with one or more fracturing fluid(s) to be used for hydraulic fracturing and/or other formation exploration processes.

FIG. 1B shows a schematic, partial cross-sectional view of another example of a downhole tool 30. The example downhole tool 30 of FIG. 1B can be conveyed among one or more of (or itself may be) a measurement-while-drilling (MWD) tool, a LWD tool, or other type of drill string downhole tools that are known to those skilled in the art. The example downhole tool 30 is attached to a drill string 32 and a drill bit 33 driven by the rig 12 and/or a mud motor (not shown) driven by mud flow to form the wellbore 11 in the geologic formation G. The wellbore 11 may be formed in the geological formation G by rotary and/or directional drilling To seal the example downhole tool 30 of FIG. 1B to the wall 20 of the wellbore 11, the downhole tool 30 may include a probe 18*a*. The example probe 18*a* of FIG. 1B forms a seal against the wall 20 and may be used to draw fluid(s) from the formation F into the downhole tool 30 as depicted by the arrows. Backup pistons 22*a* and 24*a* assist in pushing the example probe 18*a* of the downhole tool 30 against the wellbore wall 20. Drilling is stopped before the probe 18*a* is brought in contact with the wall 20.

To perform formation stress tests, the example downhole tool 30 of FIG. 1B includes (or itself may be) a stress test module 40 constructed in accordance with this disclosure. As described below in connection with FIG. 2, the example stress test module 40 includes one or more containers 235 and 236 (FIG. 2) configured to store fracturing fluid(s) to be used for stress testing of the formation F. The example stress test module 40 is fluidly coupled to the probe 18 and/or another port of the tool 10 via a flowline 46.

To load and/or fill a container of the stress test module 40 with fluid(s) to be used in stress testing the formation F, the illustrated example of FIG. 1B includes the fracturing fluid fill station 60. While the example stress test module 40 is located above ground, that is, outside of the formations G and F and the wellbore 11, the example fracturing fluid fill station 60 may be fluidly coupled to the stress test module 40 to fill the one or more containers 235 and 236 of the stress test module 40 with one or more fracturing fluid(s) to be used for hydraulic fracturing and/or other formation exploration processes.

While example methods of deploying the example stress test modules 26 and 40 within the wellbore 11 are illustrated in FIGS. 1A and 1B, any number and/or type(s) of additional and/or alternative methods can be used convey a stress test module within the wellbore 11. For example, a stress test module could be conveyed downhole via coiled tubing.

Figure 2:
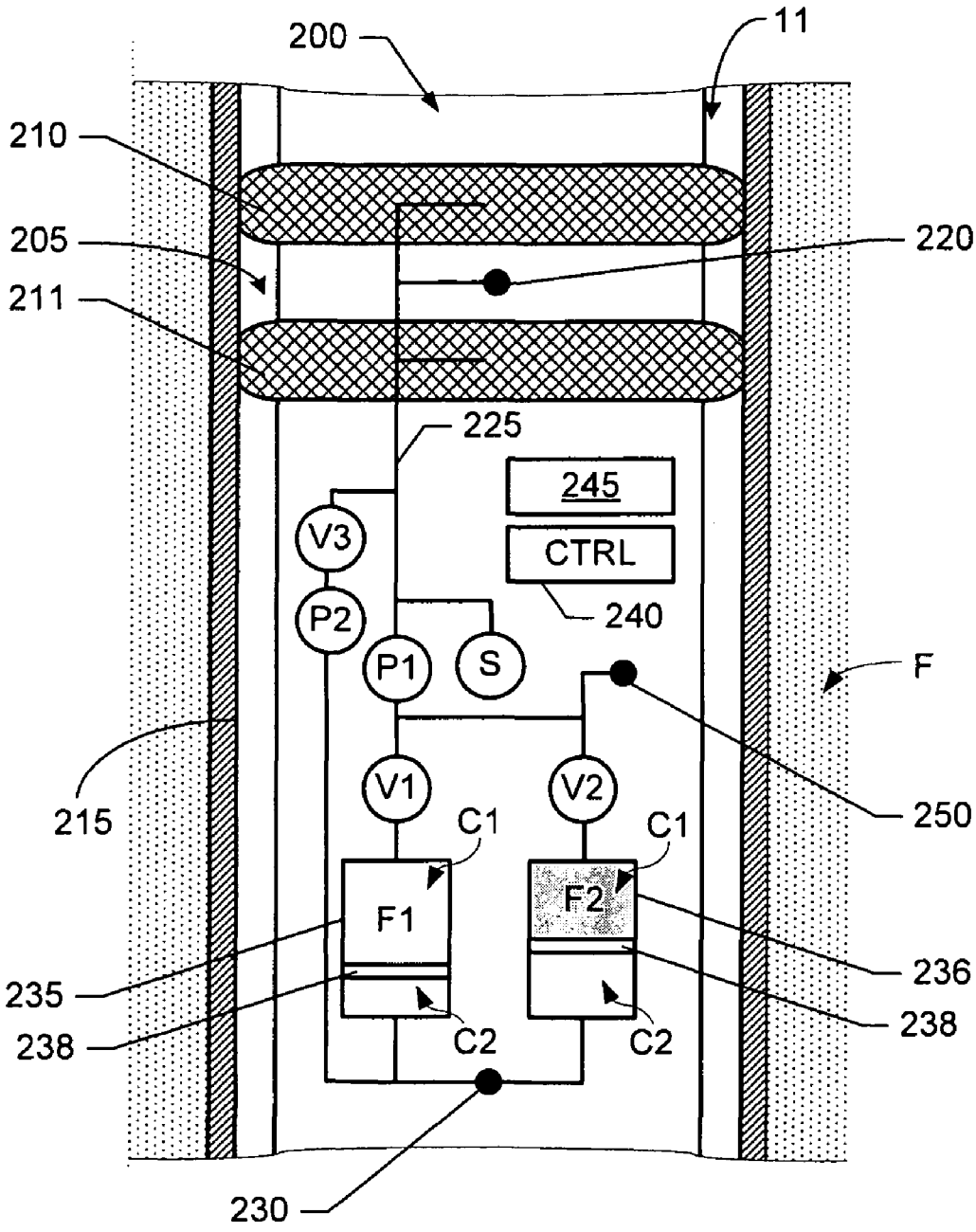
FIG. 2 depicts a block diagram of an example stress test module according to one or more aspects of the present disclosure.

FIG. 2 depicts an example stress test module 200 that may be used to implement either or both of the example stress test modules 26 and 40 and/or, more generally, either or both of the example downhole tools 10 and 30 of FIGS. 1A and 1B. While any of the modules 26 and 40 and/or any of the tools 10 and 30 may be implemented by the example device of FIG. 2, for ease of discussion, the example device of FIG. 2 will be referred to as the stress test module 200. The example stress test module 200 of FIG. 2 may be used to perform, among other things, stress testing of the geological formation F. When the example stress test module 200 is part of a drill string, the stress test module 200 includes a passage (not shown) to permit drilling mud to be pumped through the stress test module 200 to remove cuttings away from a drill bit.

To seal off an interval and/or region 205 of the example wellbore 11, the example stress test module 200 of FIG. 2 includes packers 210 and 211. The example packers 210 and 211 of FIG. 2 are inflatable elements that encircle the generally circularly shaped stress test module 200. Accordingly, the example interval 205 of FIG. 2 is an annular region. When inflated to form a seal with a wall 215 of the wellbore 11, as shown in FIG. 2, the example packers 210 and 211 form the interval 205 in which stress testing of the geological formation F may be performed. Other formation and/or formation fluid tests and/or measurements may also be performed in the inner interval 205. The example packers 210 and 211 of FIG. 2 have a height of 1.5 feet and a spacing of 3 feet. However, other size packers and/or packer spacing(s) may be used.

To allow the example pressure testing system 220 to be fluidly coupled to the interval 205, the example stress test module 200 of FIG. 2 includes a port 220. The example port 220 of FIG. 2 is fluidly coupled to other components, elements and/or devices of the stress test module 200 via any number and/or type(s) of flowlines, one of which is designated at reference numeral 225. The example stress test module 200 of FIG. 2 also includes one or more additional ports, one of which is designated at reference numeral 230, that are fluidly coupled to other portions and/or intervals of the wellbore 11. In the example of FIG. 2, the ports 220 and 230 are fluidly isolated from each other when the packer 211 is inflated. While the example port 230 is shown below the example interval 205 in FIG. 2, the port 230 may, alternatively, be located above the interval 205.

To perform stress testing, the example stress test module 200 of FIG. 2 includes one or more fluid containers (two of which are designated at reference numerals 235 and 236), one or more valves (two of which are designated at reference numerals V1 and V2), a pump P1, a sensor S, and a controller 240. The example containers 235 and 236 of FIG. 2 are pre-filled with fracturing and/or other fluids F1 and F2, respectively, before the stress test module 200 is positioned within the wellbore 11, that is, while the stress test module 200 is positioned at the surface and/or outside the formation F. Example fracturing fluids F1 and F2 that may be stored in the example containers 235 and 236 and used for stress testing are described below.

The example containers 235 and 236 of FIG. 2 each include two chambers C1 and C2. The fluids F1 and F2 to be used for stress testing or other purposes are contained in respective first chambers C1 of the containers 235 and 236, while second chambers C2 of the containers 235 and 236 are fluidly coupled to the port 230. The two chambers C1 and C2 of each of the containers 235 and 236 are separated by a piston, membrane and/or any other fluid separation means 238. When, the example fluid F1 is pumped out of the first chamber C1 of the container 235, a formation fluid and/or drilling fluid enters the second chamber C2 of the container 235 via the port 230 to equalize the pressure between the two chambers C1 and C2 of the container 235. This substantially eliminates and/or reduces a vacuum created in the container 235 when the fluid F1 is pumped from the container 235. Similarly, when the fluid F1 is pumped into the first chamber C1 of the container 235, the formation fluid and/or drilling fluid is expelled from the second chamber C2 of the container 235 via the port 230. The example container 236 of FIG. 2 operates in a similar fashion. While two containers 235 and 236 are shown in FIG. 2, a stress test module 200 may include any number of such containers.

The example valves V1 and V2 of FIG. 2 are selectively configurable and/or operable to fluidly couple the containers 235 and 236, respectively, to the pump P1 and, thus, to the flowline 225 and the port 220. The example pump P1 is selectively operable and/or configurable to pump fluids into and/or out of the interval 205 via the port 220, and/or into and/or out of the packers 210 and 211. Selective fluid coupling of flowline 225 to the packers 210 and 211 is controlled and/or configured by the controller 240 via one or more additional valves (not shown). The example valves V1 and V2 and the example pump P1 operate in response to control signals, data and/or values (not shown for clarity of illustration) received from the example controller 240. The example sensor S of FIG. 2 is configured to measure the pressure of a fluid contained in the flowline 225 and, thus, the pressure of a fluid contained in the interval 205. The example controller 240 receives from the sensor S values, data and/or signals (not shown for clarity of illustration) representative of pressures measured by the sensor S.

Figure 3:
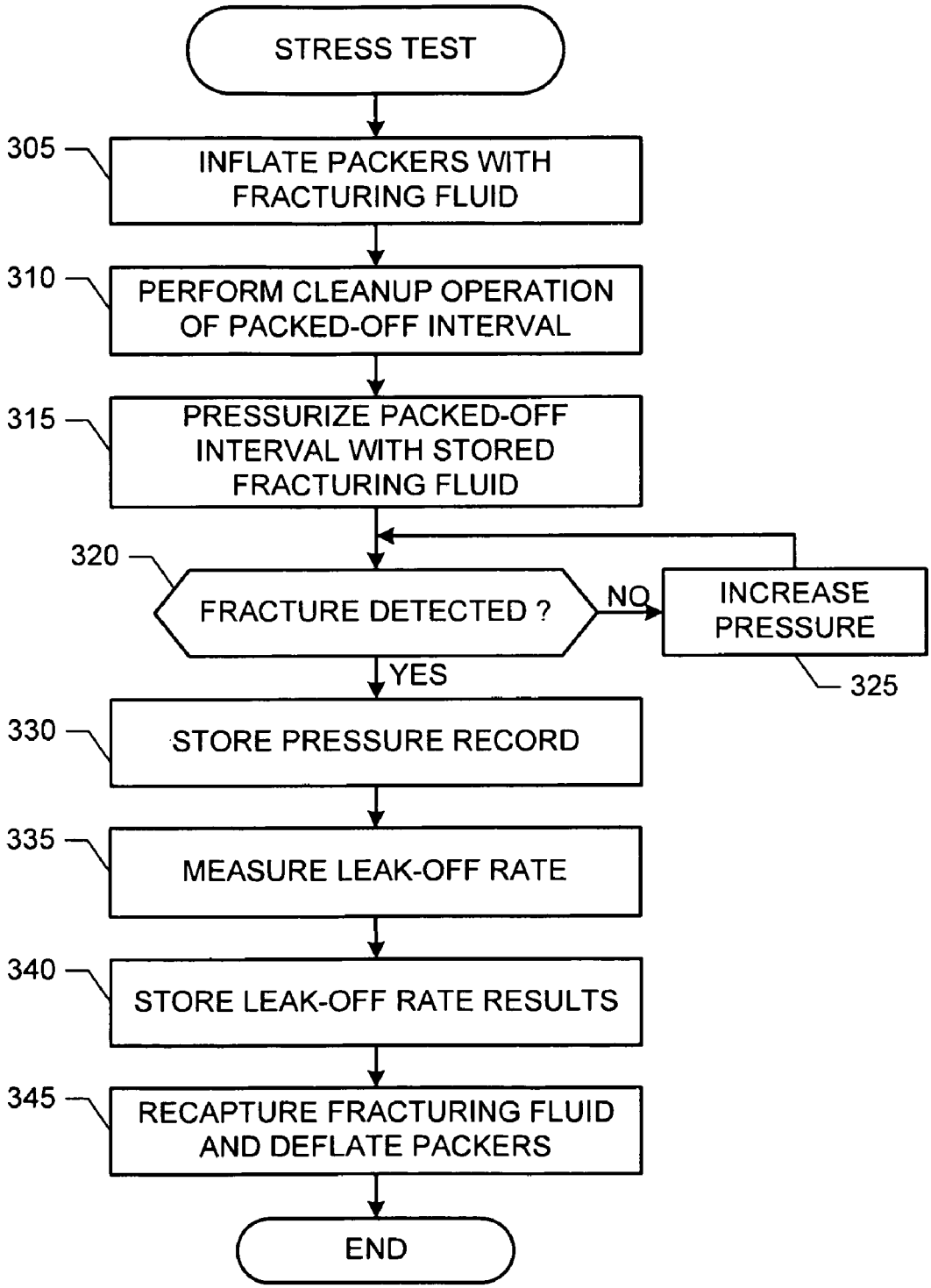
FIGS. 3 and 4 depict example processes according to one or more aspects of the present disclosure.

To store test results (e.g., the pressure record captured during a hydraulic fracturing stress test), the example stress test module 200 of FIG. 3 includes any number and/or type(s) of storage devices, one of which is designated at reference numeral 245. The example storage device 245 of FIG. 2 may be implemented by any number and/or type(s) of memory(-ies) and/or memory device(s).

To perform a cleanup operation for the interval 205, the example stress test module 200 of FIG. 2 includes a valve V3 and a pump P2. The example valve V3 is selectively configurable and/or operable to fluidly couple the flowline 225 and, thus, the interval 205, to the pump P2. The example pump P2 of FIG. 2 is selective operable and/or configurable to pump fluids into and/or out of the interval 205 via the valve V3 and the port 230. The example valve V3 and the example pump P2 operate in response to control signals, data and/or values (not shown for clarity of illustration) received from the example controller 240.

An example process that may be carried out by the example stress test module 200 of FIG. 2 to perform a stress test of the formation F is depicted in the example flowchart of FIG. 3. The example process of FIG. 3 may be carried out by a processor, a controller and/or any other suitable processing device. For example, the example process of FIG. 3 may be embodied in coded instructions stored on any tangible computer-readable medium such as a flash memory, a compact disc (CD), a digital versatile disc (DVD), a floppy disk, a read-only memory (ROM), a random-access memory (RAM), a programmable ROM (PROM), an electronically-programmable ROM (EPROM), and/or an electronically-erasable PROM (EEPROM), an optical storage disk, an optical storage device, magnetic storage disk, a magnetic storage device, and/or any other medium which can be used to carry or store program code and/or instructions in the form of machine-accessible and/or machine-readable instructions or data structures, and which can be accessed by a processor, a general-purpose or special-purpose computer, or other machine with a processor (e.g., the example processor platform P100 discussed below in connection with FIG. 6). Combinations of the above are also included within the scope of computer-readable media. Machine-readable instructions comprise, for example, instructions and/or data that cause a processor, a general-purpose computer, special-purpose computer, or a special-purpose processing machine to implement one or more particular processes. Alternatively, some or all of the example process of FIG. 3 may be implemented using any combination(s) of application specific integrated circuit(s) (ASIC(s)), programmable logic device(s) (PLD(s)), field-programmable logic device(s) (FPLD(s)), field-programmable gate array(s) (FPGA(s)), discrete logic, hardware, firmware, etc. Also, some or all of the example process of FIG. 3 may instead be implemented manually or as any combination of any of the foregoing techniques, for example, any combination of firmware, software, discrete logic and/or hardware. Further, many other methods of implementing the example operations of FIG. 3 may be employed within the scope of the present disclosure. For example, the order of execution of the blocks may be changed, and/or one or more of the blocks described may be changed, eliminated, subdivided, or combined. Additionally, any or all of the example process of FIG. 3 may be carried out sequentially and/or carried out in parallel by, for example, separate processing threads, processors, devices, discrete logic, circuits, etc.

With reference to FIGS. 2 and 3, collectively, to perform stress testing of the example formation F with the fluid F1, the example controller 240 configures the valve V1 to an open state and configures the pump P1 to pump the fluid F1 from the container 235 into the packers 210 and 211 to inflate the packers 210 and 211 to form the interval 205 (block 305). Additionally or alternatively, the pump P2 and the valve V3 may be operated to inflate the packers 210 and 211 with formation fluids and/or drilling fluids via the port 230.

The valve V1 is closed, the valve V3 opened, and the pump P2 operated to perform a cleanup operation for the interval 205 (block 310). Such a cleanup operation may be optionally performed to reduce contamination of the fluid F1 by any fluid present in the interval 205 when the packers 210 and 211 were inflated and/or contamination of the fluid F1 caused by the previous drilling operation.

The valve V3 is closed, the valve V1 reopened, and the pump P1 begins pumping the fluid F1 from the container 235 into the interval 205 to begin pressurization of the interval 205 (block 315). If a fracture has not yet been detected (block 320), the pump P1 continues to pump the fluid F1 into the interval 205 to increase the pressure in the interval 205 (block 325). While the pump P1 is pressuring the interval 205, the sensor S is collecting pressure measurements for the fluid F1 in the interval 205.

When a fracture is detected (block 320), the example controller 240 stores values representative of the pressure measurements taken by the sensor S in the storage device 245 (block 330). In the example of FIG. 3, the leak-off and/or loss rate of the formation F is measured by continuing to monitor the pressure in the interval (block 335), and results of the leak-off and/or loss rate test are stored in the storage device 245 (block 340). While a leak-off and/or loss rate test is performed in the example process of FIG. 3, it may optionally be omitted. By calibrating the leak-off and/or loss rate test results with the stress test results, the calibrated leak-off test results may be used to replace and/or obviate the need for the leak-off and/or loss rate tests traditionally performed during pre-fracture injection tests that conventionally precede pre-production fracturing, particularly when a fracturing fluid similar to that used during pre-production fracturing is used during formation stress testing. While the example stress test module 200 may be limited in the extent of reservoir sampling and/or averaging it can perform compared to the conventional pre-production pre-fracturing leak-off and/or loss rate test procedures, by calculating a weighted average of the leak-off and/or loss test results measured by the stress test module 200 at multiple positions in the wellbore 11, a comparable leak-off and/or loss profile can be generated. Additionally, by extending the pressure decline period at wellbore positions where permeability allows the flow regime to reach pseudo-radial flow behavior, test results measured by the example stress test module 200 can be used to calculate mobility and/or permeability of the formation F. Such results are traditionally measured using an impulse test.

The controller 240 configures the pump P1 to pump the fluid F1 from the interval 205 and the packers 210 and 211 back into the container 235 (block 345). By recapturing and/or reclaiming the fluid F1, the stress test module 200 of FIG. 2 can use the fracturing fluid for more than one stress test. Control then exits from the example process of FIG. 3.

It should be clear that the process of FIG. 3 may, additionally or alternatively, be used to perform stress testing with the example fluid F2, other fluids, and/or any combination and/or ratio of fluids. For example, the containers 235 and 236 may be filled with different types of fracturing fluids suitable for testing different types of formations (e.g., shale, granite, sand, etc.) without having to withdraw the stress test module 200 to change fracturing fluid. Further, if one of the containers 235 and 236 contains another type of fluid, such as an acidizing fluid, a process similar to that shown in FIG. 3 may be carried out to form the interval 205 and to introduce such a fluid into the interval 205 for any desired purpose. For example, an acidizing fluid may be introduced into the interval 205 to dissolve deposited minerals. Such a process may be formed in conjunction with and/or separate from stress testing and/or leak-off rate testing of the formation F.

Returning to FIG. 2, to allow the example containers 235 and 236 to be filled with the fluids F1 and F2, the example stress test module 200 of FIG. 2 includes any type of port, connector and/or fitting 250. While the example stress test module 200 is located above ground (e.g., at the example surface site of FIGS. 1A and 1B), the example fracturing fluid fill station 60 of FIGS. 1A and 1B can be fluidly coupled to the containers 235 and 236 via the fitting 250 and the valves V1 and V2. While fluidly coupled to the fitting 250, the fill station 60 can be operated and/or configured to fill the containers 235 and 236 with the fluids F1 and F2, respectively.

Figure 4:
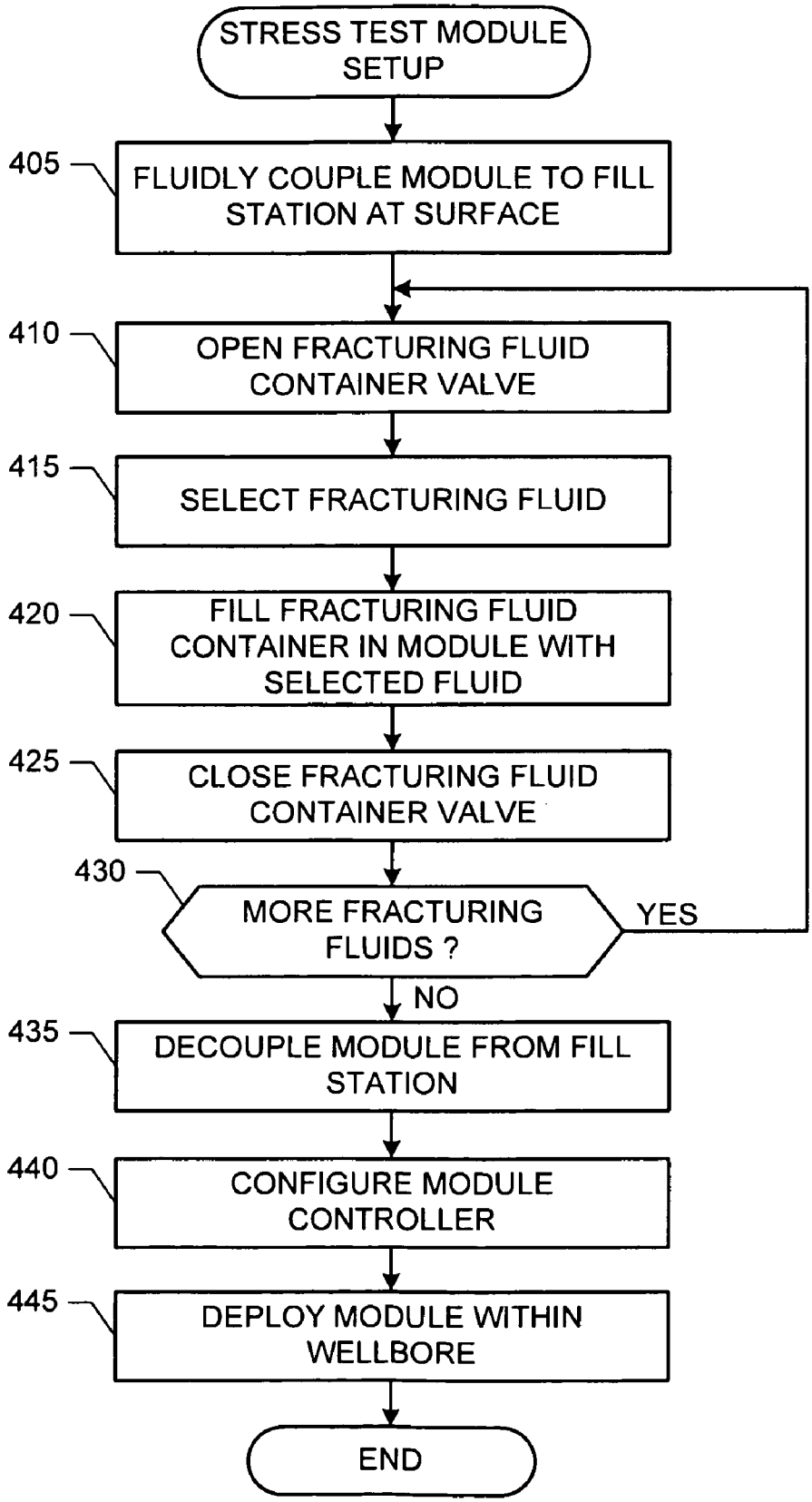

An example process that may be carried out to fill the containers 235 and 236 and/or to configure the example stress test module 200 of FIG. 2 is illustrated in FIG. 4. The example process of FIG. 4 may be carried out manually, by a processor, a controller and/or any other suitable processing device. For example, the example process of FIG. 4 may be embodied in coded instructions stored on any tangible computer-readable medium, and which can be accessed by a processor, a general-purpose or special-purpose computer, or other machine with a processor (e.g., the example processor platform P100 discussed below in connection with FIG. 6). Alternatively, some or all of the example process of FIG. 4 may be implemented using any combination(s) of ASIC(s), PLD(s), FPLD(s), FPGA(s), discrete logic, hardware, firmware, etc. Also, some or all of the example process of FIG. 4 may instead be implemented manually or as any combination of any of the foregoing techniques, for example, any combination of firmware, software, discrete logic and/or hardware. Further, many other methods of implementing the example operations of FIG. 4 may be employed within the scope of the present disclosure. For example, the order of execution of the blocks may be changed, and/or one or more of the blocks described may be changed, eliminated, sub-divided, or combined. Additionally, any or all of the example process of FIG. 4 may be carried out sequentially and/or carried out in parallel by, for example, separate processing threads, processors, devices, discrete logic, circuits, etc.

Reference will now be made to FIGS. 1, 2 and 4, collectively. The example process of FIG. 4 begins with the example fill station 60 of FIG. 1A or 1B being fluidly coupled to the example stress test module 200 via the port 250 (block 405). The valve associated with a first fluid container (e.g., the example valve V1 associated with the container 235) is opened (block 410). A fracturing or other type of fluid F1 is selected (block 415) and used to fill the fluid container 235 via the opened valve V1 and the port 250 (block 420). When the container 235 is filled, the valve V1 is closed to seal the container 235 (block 425).

If there are more containers 236 to be filled (block 430), control returns to block 415 to fill the next container 236. If there are no more containers to be filled (block 430), the stress test module 200 is fluidly decoupled from the fill station 60 (block 435). Different containers 235 and 236 may be filled with different types of fracturing fluids to permit the fracturing of different types of formations (e.g., shale, granite, sand, etc.) without having to withdraw the stress test module 200 from the wellbore to change fracturing fluid type.

The example controller 240 is configured with information and/or data regarding the fluids F1 and F2 contained in the containers 235 and 236 and/or the tests to be performed (block 440). The stress test module 200 is then deployed with the formation F, that is, within the wellbore 11 (block 445). Control then exits from the example process of FIG. 4.

While an example manner of implementing a stress test module 200 has been illustrated in FIG. 2, one or more of the elements, sensors, circuits, modules, processes and/or devices illustrated in FIG. 2 may be combined, divided, rearranged, omitted, eliminated, implemented in a recursive way, and/or implemented in any other way. Further, the example controller 240 and/or the example storage device 245 of FIG. 2 may be implemented by hardware, software, firmware and/or any combination of hardware, software and/or firmware. Thus, for example, either of the example controller 240 and/or the example storage device 245 may be implemented by one or more circuit(s), programmable processor(s), ASIC(s), PLD(s), FPLD(s), FPGA(s), etc. Further still, the stress test module 200 may include elements, sensors, circuits, modules, processes and/or devices instead of, or in addition to, those illustrated in FIG. 2 and/or may include more than one of any or all of the illustrated elements, sensors, circuits, modules, processes and/or devices.

Any number and/or type(s) of fluids may be loaded into, stored in, contained in and/or transported downhole in the example containers 235 and 236 of FIG. 2. In general, a fluid suitable for hydraulic fracturing (i.e., stress testing) is any incompressible fluid. To control fluid loss and/or to form wider and/or larger fractures, a thermally stable fluid having a sufficient viscosity, a sufficient leak off characteristic and/or an acceptable formation reaction characteristic under downhole conditions for the type of formation to be tested may be selected. Thus, any standard, tailored and/or specialized fluid suitable to induce a desired fracture in a particular formation to be tested can be used. As shear rates may vary through pumps, valves, perforations and fractures, shear thinning of non-Newtonian fluids may occur. Additionally, high downhole temperatures may reduce the viscosity of some fluids. An example fluid has an apparent viscosity of 100 centipoises (cP) at a shear rate of 100 reciprocal seconds ($sec^{-1}$) at downhole temperatures. However, fluids having a lower apparent viscosity may be suitable for simple fracture creation and/or fluid-loss control. In some instances, the viscosity of a selected fluid may be higher at surface conditions in order to achieve a target downhole viscosity. However, it is desirable that the fluid readily permits pumping of the fluid into the stress test module 200 under surface conditions. In some examples, a fluid containing fine solids may be used instead of a viscous fluid to control fluid loss and/or to form wider and/or larger fractures.

Example fluids that may be suitable for performing stress testing of and/or injection-tests on the formation F include, but are not limited to, water or brine-based fluids (including mixtures with miscible non-polar solvents or freeze-depressants such as methanol or glycols), hydrocarbon-based fluids, friction-reduced water (i.e., slickwater, and/or water containing low concentrations of high molecular weight soluble polymer) or hydrocarbons, and/or viscosified versions of same. Mixtures or combinations of water/brine and oil-based fluids may also be used. As used herein, the phase "a gelled fluid" refers to a viscosified fluid, as phrase is commonly used in the oilfield and/or geological formation exploration industries.

Example agents, compounds and/or materials that may be used to gel a water-based fluid and/or brine-based fluid include, but are not limited to, micro-mica, guar, guar derivatives (hydroxy-propyl guar, carboxy-methyl hydroxy-propyl guar, etc.), hydroxy-ethyl cellulose, cellulose derivatives, bio-polymers such as xanthan, welan or diutan gums, synthetic polymers such as polyacrylamides and co-polymers, visco-elastic micellar surfactants, and/or other polymeric agents commonly used in water-based treatment applications within the oil and gas industry. Gelling materials used may be in dry form and/or polymer dispersion in liquid. Visco-elastic micellar surfactants are solids-free, and are particular suitable for gelling water-based fluids to provide sufficient viscosity and stability for commonly encountered downhole temperatures.

When performing injection-tests in shale or clay-rich formations, a hydrocarbon (oil)-based fracturing fluid may be selected to reduce the expansion and/or deconsolidation of the shale due to ionic interaction with water-based fluids. Example fracturing fluids that may be suitable for use with shale include, but are not limited to, an oil-based fluid, a high-potassium-chloride (KCl) concentration brine, or other non clay-sensitizing fluid (containing mono/multi-valent cations), and/or a heavy-water completion brine. Such fracturing fluids may also be suitable for dirty sands and/or shale where stability and/or hydrostatic pressure control are concerns. Viscosified versions of the aforementioned fluids may be suitable for similar higher-permeability formations.

Figure 5:
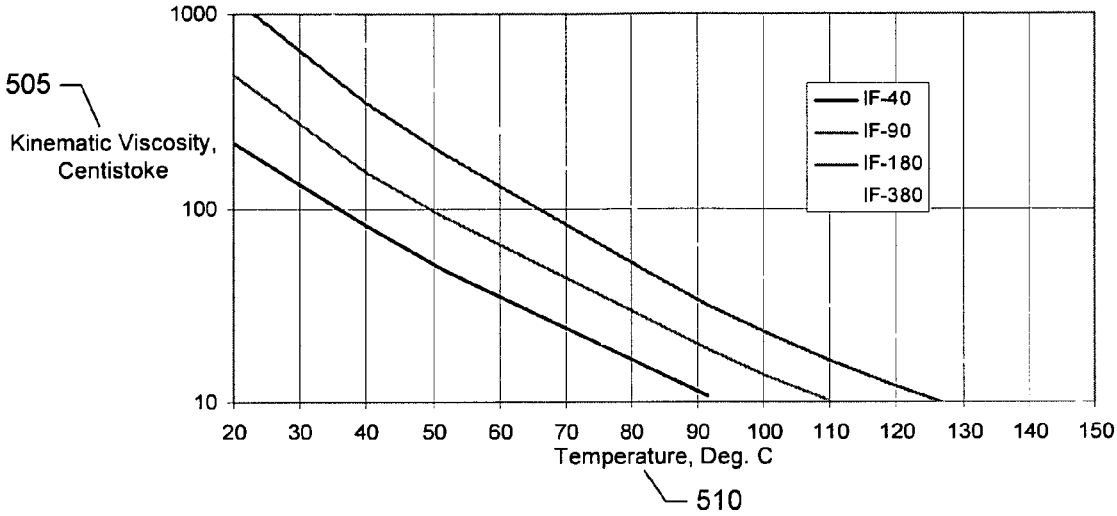
FIG. 5 depicts an example viscosity versus temperature graph according to one or more aspects of the present disclosure.

In general, an oil-based fracturing fluid is selected according to its viscosity, the expected formation permeability and the expected downhole temperature. Crude oils, fuel oils, and/or diesel oils, which have high viscosity between 5 cP and 300 cP at surface conditions, are generally suitable for hydraulic fracturing. An example of a commercially available fuel oil is 250# fuel oil, which has a viscosity of 260 cP at 20° C., and around 20 cP at 100° C. The increase in downhole temperature relative to the surface will reduce the viscosity of the fluid. Such temperature-related viscosity changes can be tested and/or measured prior to use and/or during the development of the oil. FIG. 5 depicts an example graph showing how the viscosity of IF-40, IF-90, IF-180 and IF-380 commercial fuel oils change with temperature. As shown in FIG. 5, the kinematic viscosity 505 of these fuel oils change approximately semi-log linearly with temperature 510. The commercial fuel oils shown in FIG. 5 are numbered based on their viscosity at 50° C. For example, IF-180 has a viscosity of 180 centistokes (cSt) at 50° C. While viscosity is approximately semi-log linear over 30° C. to 150° C., for wider temperature ranges (e.g., −60° C. to 300° C.), an exponential curve fit may be used when predicting fluid viscosity. For example, when a downhole stress test is to be performed at 200° C., a logarithmic function may be used to predict downhole viscosity.

Other example oils that may be suitable for hydraulic fracturing are non-toxic field crude oil, a crude oil diluted with commercial diesel to adjust the viscosity of the crude oil, a hydraulic oil such as Shell Tellus T-32 (which has a viscosity between 5 cP and 51 cP depending on temperature), Mazut 100 GOST-10185-75 (which has a viscosity close to 100 cP at 50° C.), a paraffin-based crude oil, and/or a napthene-based crude oil.

Example agents, compounds and/or materials that may be used to viscosify an oil-based fluid include a simple fatty acid soap, aluminum octoate, aluminum octoate/napthene blends, and/or naphthalene. Additionally or alternatively, liquid alkyl-phosphate esters activated with aluminum or iron solutions, and/or surfactant/ester complexes may be used. Example gelled oil-based fluids include the family of Schlumberger WideFRAC Gelled Oils (YFGOs). Such fluids are capable of maintaining sufficient viscosity over time and to temperatures of 150° C. One version, YFGO III, is commonly mixed continuously during large-scale hydraulic fracturing operations, at equal gellant and activator concentrations of 0.7-1.0% by volume. Additionally or alternatively, a batch-mixed version using lesser concentration, and a gellant to activator ratio of 2:1 may be suitable. This batch-mixed version has a lower static (low shear-rate) apparent viscosity and is therefore easier to pour. For an apparent viscosity of 50-60 cP at 100 $sec^{-1}$, a gelling agent concentration of 0.4% to 0.6% in diesel, and respective activator solution at 0.2% to 0.3% is suitable. For higher bottom-hole temperature environments (>100° C.), the YFGO IV fluid version, using the same gelling agent but different organic aluminum complex activator is suitable, providing stable viscosity to 150° C.

Unlike Newtonian crude and refined oils, where viscosity is constant for a given temperature, gelled hydrocarbon-based fluids are non-Newtonian. Accordingly, they may be characterized as "power-law" fluids, where the viscosity is dependent on both time-at-temperature and shear conditions. The apparent viscosity (μ) at any shear-rate (SR) for such fluids can be calculated using the behavior and consistency (n' and k') indices with the following mathematical expression:

$$\mu = k'/SR^{(1-n')}$$

In general, any gelled and/or viscous fluid and/or hydrocarbon are candidate fluids for hydraulic fracturing stress testing. For example, viscous gels used for other types of workover processes, such as acidizing, diversion, water control, sand control, completion brines, etc., may be suitable. Moreover, a fluid used to perform hydraulic fracturing may include any fluid and/or agent useable to control leak off rate of the fracturing fluid into the formation F.

To allow a fluid contained in the example stress test module 200 to be used for repeated stress tests, a "breaker" should not be added to the fluid, thus, allowing the fluid to remain stable over time. Such breakers are commonly used in pre-production fracturing to allow the viscosity of the fluid to degrade over time to facilitate post-fracture cleanup.

Figure 6:
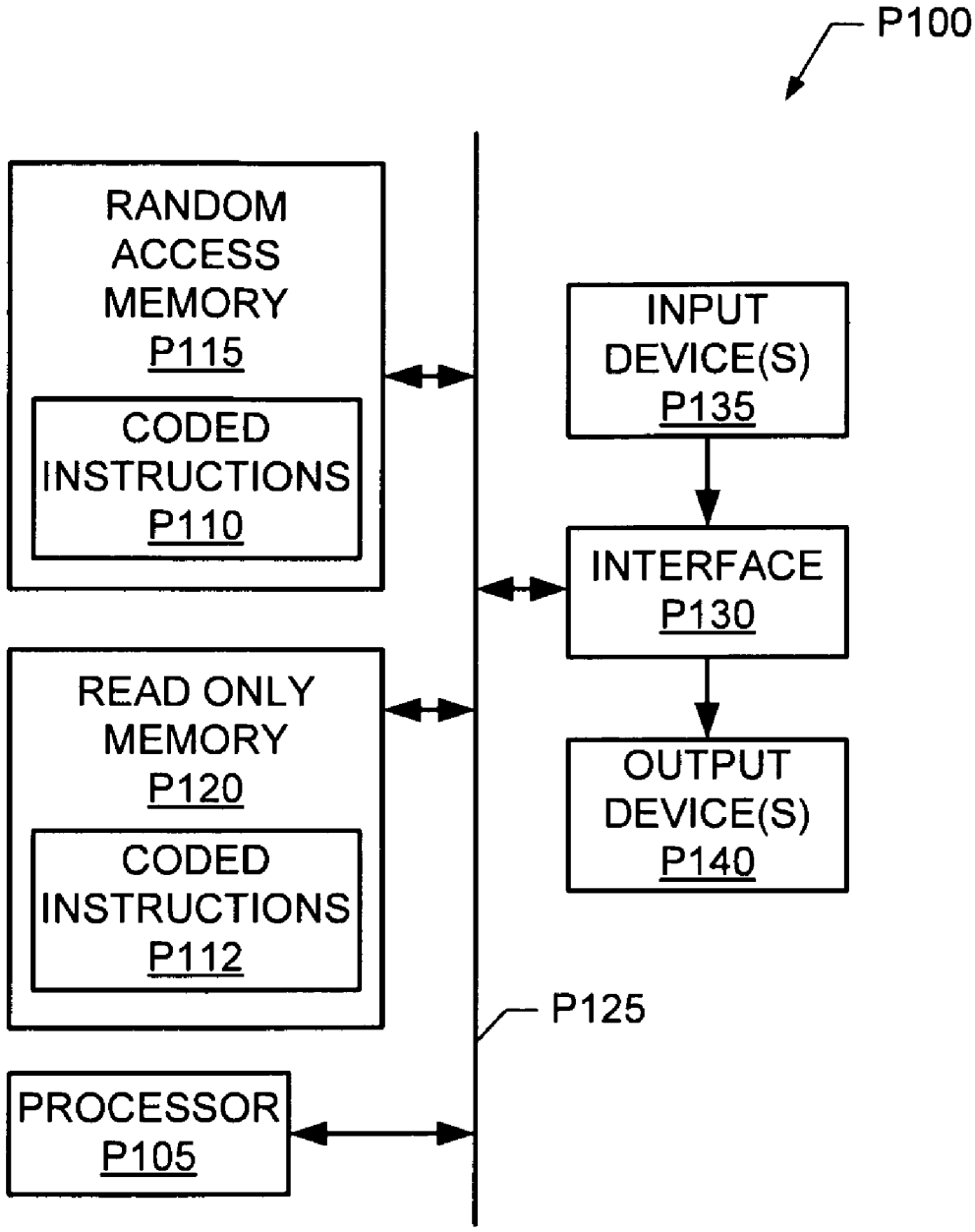
FIG. 6 depicts an example processor platform that may be used and/or programmed to the example methods and apparatus disclosed herein.

FIG. 6 is a schematic diagram of an example processor platform P100 that may be used and/or programmed to implement the example controller 240 and/or, more generally, the example stress test module 200 of FIG. 2. The example processor platform P100 can be implemented by one or more general-purpose processors, processor cores, microcontrollers, etc.

The processor platform P100 of the example of FIG. 6 includes at least one general-purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example processes of FIGS. 4 and 5 to implement the example methods and apparatus described herein.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown). The memory P115, P120 may be used to implement the example storage device 245 of FIG. 2.

The processor platform P100 also includes an interface circuit P130. The interface circuit P130 may be implemented by any type of interface standard, such as an external memory interface, serial port, general-purpose input/output, etc. One or more input devices P135 and one or more output devices P140 are connected to the interface circuit P130. The example output device P140 may be used to, for example, control, operate and/or configure the example valves V1, V2 and V3, and/or the example pumps P1 and P2 of FIG. 2. The example input device P135 may be used to, for example, receive signals, values and/or data representative of pressure measurements taken by the example sensor S.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

In view of the foregoing description and figures, it should be clear that the present disclosure describes methods and apparatus to perform downhole stress testing of a geological formation, a facilitate the estimation of other formation parameters such as transmissibility, permeability, pore-pressure, and fluid leak-off-rate behavior. In particular, the present disclosure introduces downhole stress test tool for pressure testing a geological formation where the tool may include first and second packers selectively inflatable to form an annular region around the tool, and a container configured to store a fracturing fluid, wherein the fracturing fluid is different than a formation fluid and a drilling fluid. The tool may also include a pump configured to pump the fracturing fluid into the first and second packers to inflate the first and second packers and to pump the fracturing fluid into the annular region to induce a fracture of the geological formation, and a sensor configured to detect a pressure of the fracturing fluid pumped into the annular region corresponding to the fracture of the geological formation.

The downhole stress test tool may further comprise a second pump configured to perform a cleanup operation of the annular region prior to the pump pumping the fracturing fluid into the annular region.

The container may comprise a first chamber configured to store the fracturing fluid, a second chamber fluidly coupled to a wellbore, and a separator configured to fluidly isolate the first and second chambers, wherein a second fluid present in the wellbore may flow into the second chamber when the pump pumps the fracturing fluid into at least one of the first packer, the second packer or the annular region.

The pump may be configured to reclaim at least some of the fluid from the first and second packers and the annular region into the container.

The downhole stress test tool may further comprise a valve selectively configurable to isolate the container from the pump.

The downhole stress test tool may further comprise a fill port configured to permit filling of the container with the fracturing fluid while the tool is located at the surface.

The sensor may comprise a pressure gauge.

The sensor may be configured to measure a leak-off rate of the fracturing fluid into the geological formation.

The downhole stress test tool may further comprise a storage device configured to store a value representative of the detected pressure.

The downhole stress test tool may further comprise a second container configured to store a second fluid different from the fracturing fluid, a first valve selectively configurable to fluidly couple the container to the pump, and a second value selectively configurable to fluidly couple the second container to the pump, wherein the pump may be configured to pump at least one of the fracturing fluid or the second fluid into the first and second packers to inflate the first and second packers and to pump at least one of the fracturing fluid or the second fluid into the annular region.

The fracturing fluid may not be provided to the downhole tool via a downhole string while the downhole tool is positioned within the geological formation The fracturing fluid may comprise a substantially thermally-stable viscous fluid.

The fracturing fluid may comprise a viscous gel.

The fracturing fluid may comprise a gelled fluid.

The fracturing fluid may comprise a viscosified fluid.

The fracturing fluid may have an apparent viscosity of at least 100 cP at shear rate of 100 reciprocal seconds and at a downhole temperature.

The fracturing fluid may have a viscosity in the range of 5 to 300 cP at a surface condition.

The fracturing fluid may comprise a water-based fluid.

The fracturing fluid may comprise a friction-reduced water.

The fracturing fluid may comprise a high KCl concentration brine and/or a heavy-water completion brine.

The fracturing fluid may be gelled with at least one of micro-mica, a polymeric agent, guar, a guar derivative, hydroxy-propyl guar, carboxy-methyl hydroxy-propyl guar, hydroxyl-ethyl cellulose, a cellulose derivative, a bio-polymer, a xantham gum, a synthetic polymer, a polyacrylamide, a diutan gum, a welan gum, a co-polymer, a polymeric agent, or a visco-elastic micellar surfactant.

The fracturing fluid may comprise a synthetic polymer dispersion.

The fracturing fluid may comprise a polyacrylamide dispersion.

The fracturing fluid may be or comprise a Schlumberger WideFRAC Gelled Oil (YFGO).

The fracturing fluid may comprise a non clay-sensitizing fluid.

The fracturing fluid may comprise a hydrocarbon-based fluid.

The fracturing fluid may comprise at least one of a refined oil, a hydraulic oil, or a fuel oil.

The fracturing fluid may comprise at least one of a paraffin-based crude oil, a napthene-based crude oil, or hydrocarbon viscosified with one or more of a fatty acid soap, an aluminum octoate, a blend of aluminum octoate and napthenate, a napthenate, or a surfactant ester complex.

The fracturing fluid may be gelled with at least one of a liquid alkyl-phosphate ester activated with aluminum, a liquid alkyl-phosphate ester activated with iron, an ester activated with aluminum, or an ester activated with iron.

The fracturing fluid may comprise at least one of a fluid or an agent to reduce leak off of the fracturing fluid into the geological formation.

The present disclosure also introduces a method to perform downhole testing of a geological formation where the method may inflate packers to form an annular region around a downhole tool, pressurize the formed annular region with a fracturing fluid stored in a container of the downhole tool, wherein the fracturing fluid is different than a formation fluid and a drilling fluid, and measure a value representative of a pressure of the fracturing fluid at which the geological formation is fractured.

The fracturing fluid may not be provided to the downhole tool via a downhole string while the downhole tool is positioned within the geological formation.

The packers may be inflated by pumping the fracturing fluid stored in the container into the packers.

The method may further comprise storing the value in the downhole tool for subsequent retrieval.

The method may further comprise recapturing at least some of the fracturing fluid from the annular region and storing the recaptured fluid in the container.

The present disclosure also introduces a method to configure a downhole stress test tool where the method may fluidly couple the downhole stress test tool to a surface-based fill station, open a valve of the tool to fluidly couple the fill station to a storage container of the tool, operate the fill station to fill the container with a fracturing fluid, and fluidly decouple the tool from the fill station. The method may also include positioning the tool downhole within a geological formation after the tool is decoupled from the fill station, and performing a stress test of a geological formation while the tool is positioned within the geological formation using the fracturing fluid stored in the container to pressurize the geological formation.

The method may further comprise closing the valve after the container is filled with the fracturing fluid.

The method may further comprise configuring a controller of the tool to perform the stress test using the fracturing fluid stored in the container.

What is claimed is:

1. A downhole stress test tool for pressure testing a geological formation, comprising:

first and second packers selectively inflatable to form an annular region around the tool;

a container configured to store a fracturing fluid, wherein the fracturing fluid is different from a formation fluid and a drilling fluid;

a pump configured to pump the fracturing fluid into the first and second packers to inflate the first and second packers and to pump the fracturing fluid into the annular region to induce a fracture of the geological formation; and a sensor configured to detect a pressure of the fracturing fluid pumped into the annular region corresponding to the fracture of the geological formation.

2. The downhole stress test tool of claim 1 further comprising a second pump configured to perform a cleanup operation of the annular region prior to the pump pumping the fracturing fluid into the annular region.

3. The downhole stress test tool of claim 1 wherein the container comprises a first chamber configured to store the fracturing fluid, a second chamber fluidly coupled to a wellbore, and a separator configured to fluidly isolate the first and second chambers, and wherein a second fluid present in the wellbore flows into the second chamber when the pump pumps the fracturing fluid into at least one of the first packer, the second packer or the annular region.

4. The downhole stress test tool of claim 1 wherein the pump is configured to reclaim at least some of the fluid from the first and second packers and the annular region into the container.

5. The downhole stress test tool of claim 1 further comprising a valve selectively configurable to isolate the container from the pump.

6. The downhole stress test tool of claim 1 further comprising a fill port configured to permit filling of the container with the fracturing fluid while the tool is located at the surface.

7. The downhole stress test tool of claim 1 wherein the sensor comprises a pressure gauge.

8. The downhole stress test tool of claim 1 wherein the sensor is configured to measure a leak-off rate of the fracturing fluid into the geological formation.

9. The downhole stress test tool of claim 1 further comprising a storage device configured to store a value representative of the detected pressure.

10. The downhole stress test tool of claim 1 further comprising:

a second container configured to store a second fluid different from the fracturing fluid;

a first valve selectively configurable to fluidly couple the first container to the pump;

a second valve selectively configurable to fluidly couple the second container to the pump, wherein the pump is configured to pump at least one of the fracturing fluid or the second fluid into the first and second packers to inflate the first and second packers and to pump at least one of the fracturing fluid or the second fluid into the annular region.

11. The downhole stress test tool of claim 1 wherein the fracturing fluid comprises a substance selected from the group consisting of: a substantially thermally-stable viscous fluid; a viscous gel; a gelled fluid; a viscosified fluid; a water-based fluid; a friction-reduced water; a high KCl concentration brine; a heavy-water completion brine; a gelled fluid; a synthetic polymer dispersion; a polyacrylamide dispersion; a Schlumberger WideFRAC Gelled Oil (YFGO); a non clay-sensitizing fluid; a hydrocarbon-based fluid; a refined oil; a hydraulic oil; a fuel oil; a paraffin-based crude oil; a napthene-based crude oil; a hydrocarbon viscosified with at least one of a fatty acid soap, an aluminum octoate, a blend of aluminum octoate and napthenate, a napthenate, or a surfactant ester complex; and a fluid or an agent configured to reduce leak off of the fracturing fluid into the geological formation.

12. A method of performing downhole testing of a geological formation, comprising:

inflating packers to form an annular region around a downhole tool;

pressurizing the formed annular region with a fracturing fluid stored in a container of the downhole tool, wherein the fracturing fluid is different from a formation fluid and a drilling fluid; and measuring a value representative of a pressure of the fracturing fluid at which the geological formation is fractured.

13. The method of claim 12 wherein the fracturing fluid is not provided to the downhole tool via a downhole string while the downhole tool is positioned within the geological formation.

14. The method of claim 12 wherein the packers are inflated by pumping the fracturing fluid stored in the container into the packers.

15. The method of claim 12 further comprising storing the value in the downhole tool for subsequent retrieval.

16. The method of claim 12 further comprising:

measuring a fluid loss rate for the geological formation fracture.

17. The method of claim 12 further comprising:

recapturing at least some of the fracturing fluid from the annular region; and storing the recaptured fluid in the container.

18. A method to configure a downhole stress test tool, comprising:

fluidly coupling the downhole stress test tool to a surface-based fill station;

opening a valve of the tool to fluidly couple the fill station to a storage container of the tool;

operating the fill station to fill the container with a fracturing fluid;

fluidly decoupling the tool from the fill station;

positioning the tool downhole within a geological formation after the tool is decoupled from the fill station; and performing a stress test of a geological formation while the tool is positioned within the geological formation using the fracturing fluid stored in the container to pressurize the geological formation.

19. The method of claim 18 further comprising closing the valve after the container is filled with the fracturing fluid.

20. The method of claim 18 further comprising configuring a controller of the tool to perform the stress test using the fracturing fluid stored in the container.

* * * * *